US007690648B2

(12) United States Patent
Utsumi et al.

(10) Patent No.: US 7,690,648 B2
(45) Date of Patent: Apr. 6, 2010

(54) SHEET ALIGNING DEVICE OF A PRINTING PRESS AND METHOD OF CONTROLLING THE SAME

(75) Inventors: Kiyomi Utsumi, Fuchu (JP); Masazumi Hidera, Fuchu (JP); Masamichi Sasaki, Fuchu (JP)

(73) Assignee: Ryobi Ltd., Hiroshioma-Ken (JP)

( * ) Notice: Subject to any disclaimer, the term of this patent is extended or adjusted under 35 U.S.C. 154(b) by 248 days.

(21) Appl. No.: 11/407,732

(22) Filed: Apr. 19, 2006

(65) Prior Publication Data

US 2006/0237901 A1 Oct. 26, 2006

(30) Foreign Application Priority Data

Apr. 20, 2005 (JP) ..... 2005-122460

(51) Int. Cl.
*B65H 9/00* (2006.01)

(52) U.S. Cl. ..... 271/240; 271/252

(58) Field of Classification Search ..... 271/240, 271/250, 252

See application file for complete search history.

(56) References Cited

U.S. PATENT DOCUMENTS

| | | | | |
|---|---|---|---|---|
| 5,358,236 | A | 10/1994 | Maass et al. | |
| 6,454,256 | B1 | 9/2002 | Boguhn et al. | |
| 6,510,670 | B1 * | 1/2003 | Janhonen | 53/209 |
| 2006/0170149 | A1 * | 8/2006 | Seto | 271/240 |

FOREIGN PATENT DOCUMENTS

| | | |
|---|---|---|
| DE | 4211922 A1 | 10/1993 |
| DE | 3851629 T2 | 10/1994 |
| JP | 2000-34042 | 2/2000 |
| JP | 2000-280453 | 10/2000 |

OTHER PUBLICATIONS

CN Office Action mailed Apr. 25, 2008; in Chinese Application Serial No. 200610073687.7, which priority to the present JP application of the present matter.

* cited by examiner

*Primary Examiner*—Patrick H Mackey
*Assistant Examiner*—Michael C McCullough
(74) *Attorney, Agent, or Firm*—Perkins Coie, LLP

(57) ABSTRACT

A sheet aligning device includes first and second aligning plates disposed on opposite lateral sides of the feeder board, the first and second aligning plates being capable of being reciprocatingly moved in a direction orthogonal to a sheet conveying direction and each having a sheet abutting surface parallel to the sheet conveying direction, an input member for inputting a sheet width, and a controller for controlling the first and second aligning plates so that the first aligning plate is moved, based on the inputted sheet width, to allow the sheet abutting surface thereof to be brought into abutment with a first lateral side of each sheet, thereby laterally aligning the sheet, and the second aligning plate is moved, based on the inputted sheet width, to allow a second lateral side of each sheet close to the second aligning plate to pass through a sheet-lateral-side passing zone on the second aligning plate. The sheet-lateral-side passing zone is located closer to the axis or centerline of the sheet than the sheet abutting surface is and has a flat surface throughout the sheet conveying direction.

4 Claims, 6 Drawing Sheets

SHEET ALIGNING DEVICE OF A PRINTING PRESS AND METHOD OF CONTROLLING THE SAME

CROSS REFERENCE TO RELATED APPLICATION

This application claims priority from Japanese Patent Application No. 2005-122460, which is incorporated herein by reference.

BACKGROUND OF THE INVENTION

1. Field of the Invention

The present invention relates to a sheet aligning device disposed downstream of a feeder board for laterally aligning each of sheets of paper during the sheet is conveyed by the feeder board from a sheet feeder to a printing unit and a method of controlling the same, and more specifically a sheet aligning device for laterally aligning each of sheets of paper, which has plural aligning plates capable of being reciprocatingly moved in a direction orthogonal to the sheet conveying direction and a method of controlling the same.

2. Related Art

A feeder board that conveys sheets of paper (hereinafter simply referred to sheets) from a sheet feeder to a printing unit is provided with a sheet aligning device (also called as a pulling device) for lateral alignment of each sheet. This aligning device has an aligning plate (also called as a pulling plate) with a sheet abutting surface parallel to the sheet conveying direction, which is reciprocatingly movable in a direction orthogonal to the sheet conveying direction, so that the aligning plate is preset at a given position to allow each sheet conveyed to have its lateral side abutting against the sheet abutting surface, thereby limiting the lateral displacement or offset of each sheet and hence laterally aligning each sheet.

As described in Japanese Patent Application Laid-open No. 2000-280453, it is known that an additional aligning plate is disposed opposite to the aforesaid aligning plate on the opposite lateral sides of the feeder board so that the lateral displacement or offset of each sheet is limited by at least one of the oppositely disposed aligning plates, according to the size of the sheets or the printing mode.

According to the above arrangement having the aligning plates disposed opposite to each other on the opposite lateral sides of the feeder board, one of the aligning plates is used for alignment, while the residual one is retracted as far as possible towards a corresponding lateral side of the feeder board.

According to needs and circumstances, each aligning plate is sometimes provided with a sheet pulling device made up of such as a pressing roller for pulling each sheet towards the sheet abutting surface, or is incorporated with a guide mechanism in the form of, for example, a bellows mechanism whose end is mounted to a laterally inward side of the aligning plate, which side is located close to the axis or centerline of the sheet to be conveyed so as to prevent intrusion of foreign matters such as a sheet into a moving path of the aligning plate. Meanwhile, a limited space of a printing press or the feeder board may poses a possibility that a lateral side of a sheet, if the sheet has an excessive size or the like, passes on the aligning plate out of use for alignment, even when the aligning plate is retracted to a farthermost position close to the corresponding lateral side of the feeder board. When the sheet side passes over the sheet pulling member of the aligning plate or the mounting portion of the guide mechanism, the sheet may be blocked or interrupted at these positions, causing the sheet is obliquely displaced from the right place. This may lead to a problem of poor alignment of the sheet in the lateral direction and hence errors in registration for printing.

It is an object of the present invention to provide a sheet aligning device that includes aligning plates disposed on the opposite lateral sides of a feeder board so as to allow any one of them to be operated for alignment of sheets and that is capable of preventing errors in registration for printing, and a method of controlling the same.

SUMMARY OF THE INVENTION

According to an aspect of the present invention, there is provided a sheet aligning device of a printing press disposed downstream of a feeder board for laterally aligning each of sheets of paper during the sheet is conveyed by the feeder board from a sheet feeder to a printing unit in a sheet conveying direction. The sheet aligning device includes: first and second aligning plates disposed on opposite lateral sides of the feeder board, the first and second aligning plates being capable of being reciprocatingly moved in a direction orthogonal to the sheet conveying direction and each having a sheet abutting surface parallel to the sheet conveying direction; an input member for inputting a sheet width; and a controller for controlling the first and second aligning plates so that the first aligning plate is moved, based on the inputted sheet width, to allow the sheet abutting surface thereof to be brought into abutment with a first lateral side of each sheet, thereby laterally aligning the sheet, and the second aligning plate is moved, based on the inputted sheet width, to allow a second lateral side of each sheet close to the second aligning plate to pass through a sheet-lateral-side passing zone on the second aligning plate, the sheet-lateral-side passing zone being located closer to the axis or centerline of the sheet than the sheet abutting surface is and having a flat surface throughout the sheet conveying direction.

With the thus arranged sheet aligning device, the first and second aligning plates each having the sheet abutting surface and capable of being reciprocatingly moved in a direction orthogonal to the sheet conveying direction are disposed on the opposite lateral sides of the feeder board, and the controller controls the first and second aligning plates based on the sheet width inputted through the input member, thereby laterally aligning the sheet.

Herein, the controller controls, based on the inputted sheet width, the second aligning plate (an aligning plate out of use for alignment) to move the same to allow a second lateral side of each sheet close to the second aligning plate to pass through the sheet-lateral-side passing zone on the second aligning plate, in which the sheet-lateral-side passing zone is located closer to the axis or centerline of the sheet than the sheet abutting surface is and has a flat surface throughout the sheet conveying direction.

Accordingly, even the aligning plate out of use for aligning is controlled to be positively moved so that the second lateral side of each sheet is allowed to pass through a given area (the sheet-lateral-side passing zone) where the lateral side of each sheet is not blocked or interrupted. Thus it is possible to achieve prevention of errors in registration for printing.

According to another aspect of the present invention, there is provided a sheet aligning device of a printing press disposed downstream of a feeder board for laterally aligning each of sheets of paper during each sheet is conveyed by the feeder board from a sheet feeder to a printing unit in a sheet conveying direction. The sheet aligning device includes: first and second aligning plates disposed on opposite lateral sides of the feeder board, the aligning plates being capable of being reciprocatingly moved in a direction orthogonal to the sheet conveying direction and each having a sheet abutting surface parallel to the sheet conveying direction; an input member for inputting a sheet width; and a controller for controlling the first and second aligning plates so that the first aligning plate is moved to allow the sheet abutting surface thereof to be brought into abutment with a first lateral side of each sheet, thereby laterally aligning the sheet, and the second aligning plate is moved to allow a second lateral side of each sheet to pass through a sheet-lateral-side passing zone on the second aligning plate in a case where the inputted sheet width is equal to or larger than a given sheet width, the sheet-lateral-side passing zone being located closer to the axis or centerline of the sheet than the sheet abutting surface of the second aligning plate is and having a flat surface throughout the sheet conveying direction, while the second aligning plate is moved to allow the second lateral side of each sheet to pass through a given area in a case where the inputted sheet width is smaller than the given sheet width, the given area being located away from a laterally inward side of the second aligning plate, the laterally inward side being close to the axis or centerline of the sheet.

With the thus arranged sheet aligning device, the first and second aligning plates each having the sheet abutting surface and capable of being reciprocatingly moved in a direction orthogonal to the sheet conveying direction are disposed on the opposite lateral sides of the feeder board, and the controller controls the first and second aligning plates based on the sheet width inputted through the input member, thereby laterally aligning the sheet.

Herein, the controller controls the aligning plate out of use for alignment (the second aligning plate) to move to allow a second lateral side of each sheet to pass through a sheet-lateral-side passing zone on the second aligning plate in a case where the inputted sheet width is equal to or larger than a given sheet width, in which the sheet-lateral-side passing zone is located closer to the axis or centerline of the sheet than the sheet abutting surface of the second aligning plate is and has a flat surface throughout the sheet conveying direction, while controlling the second aligning plate to move the same to allow the second lateral side of each sheet to pass through a given area in a case where the inputted sheet width is smaller than the given sheet width, in which the given area is located away from a laterally inward side of the second aligning plate, the laterally inward side being close to the axis or centerline of the sheet. For example, the second aligning plate is moved or retracted towards the corresponding lateral side of the feeder board as far as possible from the sheet to be aligned. That is, in a case where the width of the sheet to be conveyed is smaller than a given value, the aligning plate out of use for alignment (the second aligning plate) is retracted on the feeder board to a position sufficiently away from the sheet to be aligned, and this aligning plate out of use (the second aligning plate) is positively controlled to a given area on the aligning plate out of use for alignment (the second aligning plate) where the corresponding lateral side of each sheet is not blocked or interrupted. This positive movement by the control is made only for a sheet having the width equal to or larger than the given value that necessarily passes on the aligning plate out of use for alignment (the second aligning plate) even when the aligning plate out of use for alignment (the second aligning plate) is retracted on the feeder board to a position (maximum retract position) sufficiently away from the sheet or retracted.

Thus, it is possible to allow each sheet to smoothly pass through during the alignment operation without block or interruption and hence achieve prevention of errors in registration for printing by positively moving even the aligning plate out of use to a given portion (the sheet-lateral-side passing zone) where the sheet can smoothly pass through without block or interruption. This control is made only for the sheet having a width equal to or larger than a given value and therefore the time for this operation can be shortened, thus allowing the printing operation to be rapidly started.

It is also possible to employ an arrangement where the first and second aligning plates each have a sheet pulling device between the sheet abutting surface and the laterally inward side thereof, which laterally inward side being close to the axis or centerline of the sheet, and any one of a first area and a second area is allocated as the sheet-lateral-side passing zone of each of the first and second aligning plates, in which the first area is defined between the corresponding sheet abutting surface and the corresponding sheet pulling device and has a flat surface throughout the sheet conveying direction, and the second area is defined between the corresponding laterally inward side and the corresponding sheet pulling device and has a flat surface throughout the sheet conveying direction.

In the above arrangement, the sheet pulling device and the laterally inward side, of the aligning plate out of use for alignment may cause block or interruption against a sheet. Therefore, any one of the first area and the second area is allocated as the sheet-lateral-side passing zone of each of the first and second aligning plates, in which the first area is defined between the corresponding sheet abutting surface and the corresponding sheet pulling device, while the second area is defined between the corresponding laterally inward side and the corresponding sheet pulling device, and has a flat surface throughout the sheet conveying direction, so that the control in the above moving operation can be made so as to prevent errors in registration for printing. Furthermore, the sheet-lateral-side passing zones are formed in the both lateral sides with the sheet pulling device therebetween so that the moving distance of the corresponding aligning plate can be reduced. Thus, the operation time for alignment can be shortened and hence the printing operation can be rapidly started.

The sheet pulling devices each may include a pressing roller for pulling each sheet towards to the corresponding sheet abutting surface while applying a pressure thereon and a receiving roller disposed opposite to the pressing roller.

According to still another aspect of the present invention, there is provided a sheet aligning device of a printing press disposed downstream of a feeder board for laterally aligning each of sheets of paper during each sheet is conveyed by the feeder board from a sheet feeder to a printing unit in a sheet conveying direction. The sheet aligning device includes: first and second aligning plates disposed on opposite lateral sides of the feeder board, the first and second aligning plates being capable of being reciprocatingly moved in a direction orthogonal to the sheet conveying direction and each having a sheet abutting surface parallel to the sheet conveying direction; an input member for inputting a sheet width; and a controller for controlling the first and second aligning plates so that the first aligning plate is moved, based on the inputted sheet width, to allow the sheet abutting surface thereof to be brought into abutment with a first lateral side of each sheet, thereby laterally aligning the sheet. The first and second aligning plates each have a recess for accommodation of a sheet pulling device disposed on each of the first and second aligning plates. The controller controls, based on the inputted sheet width, the second aligning plate to move to allow a second lateral side of each sheet to pass through a sheet-lateral-side passing zone. The sheet-lateral-side passing zone includes at least one of a first area and a second area, in which the first area is located closer to the axis or centerline of the sheet than the sheet abutting surface of the second aligning plate is and has a flat surface throughout the sheet conveying direction, and the second area is located inwardly away from a laterally inner side of the recess with a given distance.

With the thus arranged sheet aligning device, the first and second aligning plates each having the sheet abutting surface and capable of being reciprocatingly moved in a direction orthogonal to the sheet conveying direction are disposed on the opposite lateral sides of the feeder board, and the controller controls the first and second aligning plates based on the sheet width inputted through the input member, thereby laterally aligning the sheet.

In the above arrangement, the first and second aligning plates each have a recess for accommodation of a sheet pulling device disposed on each of the first and second aligning plates. The controller controls, based on the inputted sheet width, the aligning plate out of use for alignment (the second aligning plate) to move to allow a second lateral side of each sheet to pass through a sheet-lateral-side passing zone. The sheet-lateral-side passing zone includes at least one of a first area and a second area, in which the first area is located closer to the axis or centerline of the sheet than the sheet abutting surface of the second aligning plate is and has a flat surface throughout the sheet conveying direction, and the second area is located inwardly away from a laterally inward side of the recess with a given distance.

Thus, it is possible to allow the sheet to smoothly pass through during the alignment operation without block or interruption and hence achieve prevention of errors in registration for printing by positively moving even the aligning plate out of use to allow a lateral side (the second lateral side) of each sheet to pass through a given area (the sheet-lateral-side passing zone) where the sheet can smoothly pass through without block or interruption.

According to yet another aspect of the present invention, there is provided a method of controlling a sheet aligning device of a printing press disposed downstream of a feeder board for laterally aligning each of sheets of paper during each sheet is conveyed by the feeder board from a sheet feeder to a printing unit in a sheet conveying direction, by using first and second aligning plates that are disposed on the opposite lateral sides of the feeder board, the first and second aligning plates being capable of being reciprocatingly moved in a direction orthogonal to the sheet conveying direction and each having a sheet abutting surface parallel to the sheet conveying direction. The method includes: controlling the first aligning plate to move the same, based on the width of a sheet to be conveyed, to allow the sheet abutting surface thereof to be brought into abutment with a first lateral side of the sheet, thereby laterally aligning the sheet; and controlling the second aligning plate to move, based on the width of a sheet to be conveyed, to allow a second lateral side of the sheet, which is close to the second aligning plate, to pass through a sheet-lateral-side passing zone on the second aligning plate, the sheet-lateral-side passing zone being located closer to the axis or centerline of the sheet than the sheet abutting surface is and having a flat surface throughout the sheet conveying direction.

According to another aspect of the present invention, there is provided a method of controlling a sheet aligning device of a printing press disposed downstream of a feeder board for laterally aligning each of sheets of paper during each sheet is conveyed by the feeder board from a sheet feeder to a printing unit in a sheet conveying direction, by using first and second aligning plates that are disposed on opposite lateral sides of the feeder board, the first and second aligning plates being capable of being reciprocatingly moved in a direction orthogonal to the sheet conveying direction and each having a sheet abutting surface parallel to the sheet conveying direction. The method includes: controlling the first aligning plate to move the same to allow the sheet abutting surface thereof to be brought into abutment with a first lateral side of each sheet, thereby laterally aligning the sheet; and controlling the second aligning plate to move the same to allow a second lateral side of each sheet to pass through a sheet-lateral-side passing zone on the second aligning plate in a case where the width of the sheet is equal to or larger than a given sheet width, the sheet-lateral-side passing zone being located closer to the axis or centerline of the sheet than the sheet abutting surface of the second aligning plate is and having a flat surface throughout the sheet conveying direction, while controlling the second aligning plate to move the same to allow the second lateral side of each sheet to pass through a given area in a case where the width of the sheet is smaller than the given sheet width, the given area being located away from a laterally inward side of the second aligning plate, the laterally inward side being located close to the axis or centerline of the sheet.

With the above method, a second lateral side of each sheet close to the second aligning plate is allowed to pass through the sheet-lateral-side passing zone on the second aligning plate, in which the sheet-lateral-side passing zone is located closer to the axis or centerline of the sheet than the sheet abutting surface is and has a flat surface throughout the sheet conveying direction.

Thus, it is possible to allow the sheet to smoothly pass through during the alignment operation without block or interruption and hence achieve prevention of errors in registration for printing by positively moving even the aligning plate out of use for alignment to allow a lateral side (the second lateral side) of each sheet to pass through a given area (the sheet-lateral-side passing zone) where the sheet can smoothly pass through without block or interruption.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
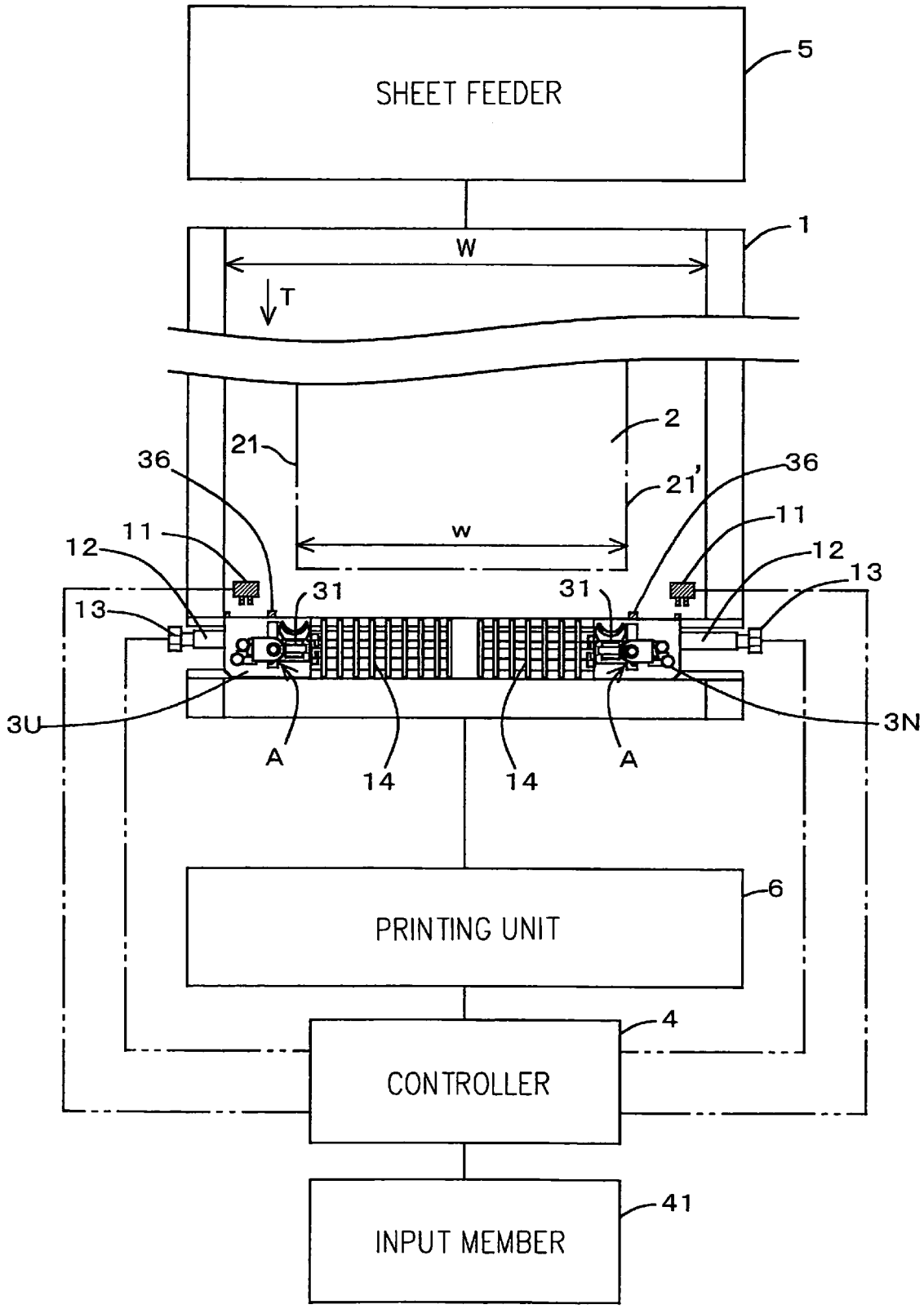
FIG. 1 is a schematic block diagram illustrating a structure of a printing press with a feeder board illustrated at the center, in which a sheet aligning device according to one embodiment of the present invention is mounted on the feeder board.
Figure 2A:
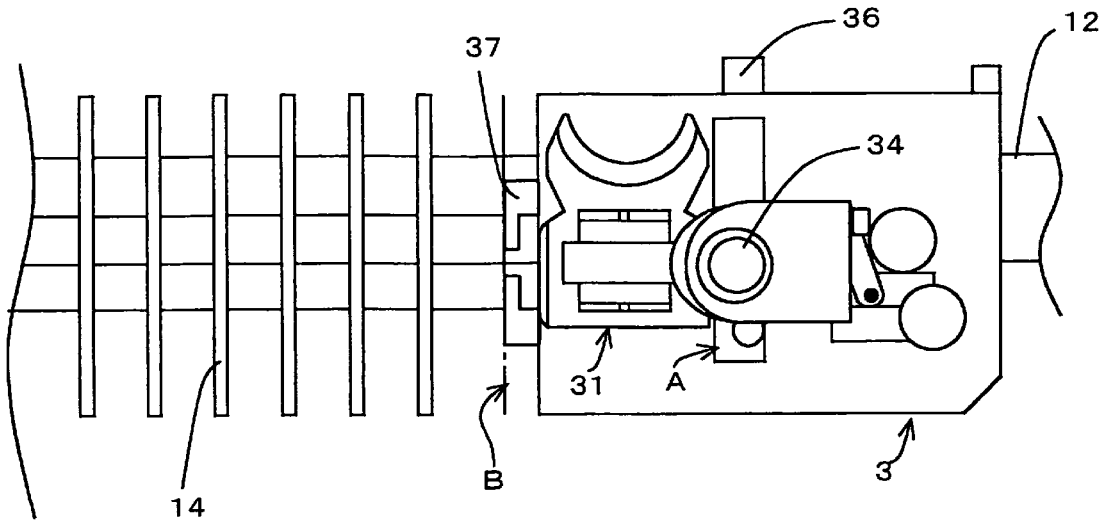
FIGS. 2A and 2B are schematic views illustrating an aligning plate and its periphery of the sheet aligning device of FIG. 1.
Figure 2B:
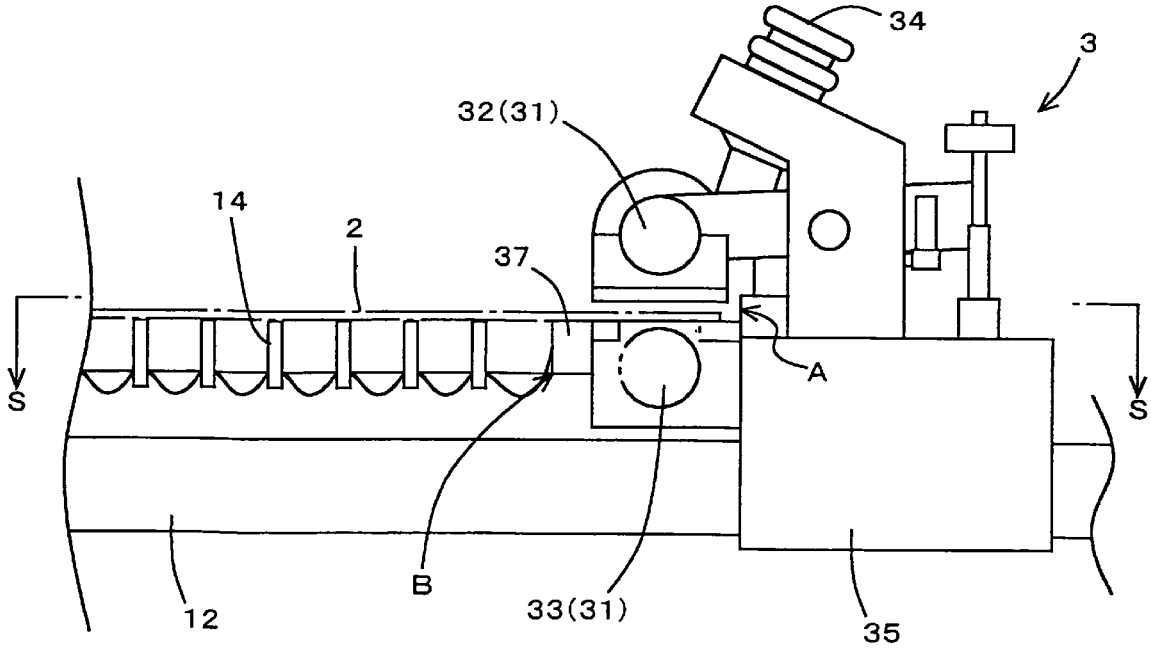

Now, the description will be made for embodiments of the present invention with reference to the drawings attached hereto. FIG. 1 is a schematic block diagram illustrating a structure of a printing press with a feeder board illustrated at the center, in which a sheet aligning device according to one embodiment of the present invention is mounted on the feeder board. FIGS. 2A and 2B are schematic views illustrating an aligning plate and its periphery of the sheet aligning device of FIG. 1, in which FIG. 2A illustrates a feeder board as viewed from above perpendicular to the top plane, and FIG. 2B illustrates the feeder board as viewed from a side thereof parallel to the sheet conveying direction of the feeder board.

A printing system of this embodiment includes, as illustrated in FIG. 1, a feeder board 1 that conveys sheets 2 from a sheet feeder 5 to a printing unit 6; an aligning device of a printing press disposed downstream of the feeder board 1 for aligning the sheets 2 laterally or with respect to a lateral or widthwise direction W of the feeder board 1, which is made up of aligning plates 3 (3U, 3N) disposed on the opposite lateral sides of the feeder board 1 in the lateral direction W, each being capable of being reciprocatingly moved in a direction orthogonal to a sheet conveying direction T and having a sheet abutting surface A parallel to the sheet conveying direction T; an input member 41 for inputting the width w of the sheets 2 to be conveyed; and a controller 4 for control of the aligning plates 3U, 3N for bringing the sheet abutting surface A of one of the aligning plates 3 (3U in this embodiment, hereinafter referred to a first aligning plate) into abutment with a lateral side 21 (hereinafter referred to a first lateral side) of the sheet 2, thereby aligning the sheet 2 laterally or with respect to the widthwise direction W. More specifically, the controller 4 controls, based on the width of the sheet inputted through the input member 41, the first aligning plate 3U to move into abutment with the first lateral side 21 of the sheet 2, while controls another aligning plate (3N in this embodiment, hereinafter referred to a second aligning plate) to move to a position allowing a second lateral side 21' to pass through a sheet-lateral-side passing zone P (P1 or P2) on the second aligning plate 3N, which zone is located closer to the axis or centerline of the sheet 2 than the sheet abutting surface A is and has a flat surface throughout the sheet conveying direction, in a case where the width w of the sheet 2 inputted is equal to or larger than a given sheet width X ($X_1$ or $X_2$), and controls the second aligning plate 3N to move to a position allowing the second lateral side 21' of the sheet 2 to pass through a portion P3, which is located away from a laterally inward side B (a side close to the axis or centerline of the sheet 2) of the second aligning plate 3N, in a case where the width w of the sheet 2 inputted is smaller than the given sheet width $X_2$.

In this embodiment, the aligning plates 3 each has, as illustrated in FIGS. 2A and 2B, a sheet pulling device 31 that is disposed between the sheet abutting surface A and the laterally inward side B and is made up of a pressing roller 32 mounted on the upper side of the feeder board 1 and a receiving roller 33 disposed in an opening defined in a plate surface extending flush with the feeder board 1 so as to face to the pressing roller 32. In the first aligning plate 3U for use in aligning sheets, the pressing roller 32 and the receiving roller 33 are rotated so as to pull the oncoming sheet 2 towards the sheet abutting surface A. More specifically, a pressing cylinder 34 is actuated when the sheet 2 is conveyed so as to allow the pressing roller 32 to apply pressure to the sheet 2 and the receiving roller 33, thereby pulling the sheet 2 into abutment with the sheet abutting surface A. Thus, the sheet 2 is aligned in the lateral or widthwise direction.

The aligning plates 3 are mounted to a driving shaft 12 mounted on the feeder board 1, via a driving member 35, and reciprocatingly movable in the widthwise direction W of the feeder board 1 by rotating an adjustable screw 35 mounted at an end of the driving shaft 12. The adjustable screw 13 is automatically rotatable based on a control signal from the controller 4, but may be rotated manually by an operator to move the aligning plates 3.

An original position sensor 11 is disposed on each side of the feeder board 1 to present a reference for moving the corresponding aligning plate 3 based on a control signal from the controller 4, and a reference member (protrusion) 36 is provided on each of the aligning plates 3. The original position sensor 11 detects the reference member 36 of the corresponding aligning plate 3 so as to check the original position thereof, and thus compensating for control errors in movement of the corresponding aligning plate 3.

The aligning plates 3 each have a laterally inward side E (a side close to the axis or centerline of the sheet) in a plate flat portion thereof, which side portion is provided with a bellows-mechanism mounting portion 37, through which a bellows mechanism 14 is mounted so as to prevent unexpected intrusion of the sheets 2 or any foreign matters into paths through which the aligning plates 3 move.

In the above arrangement, the sheet pulling device 31 (especially the opening in which the receiving roller 33 is fitted) and an outer end of the bellows-mechanism mounting portion 37 (or the laterally inward side B of each aligning plate 3) are portions, against which the lateral sheet end 21 or 21' of the sheet 2 is easy to be caught or hooked, causing errors in registration for printing.

The controller 4 has a CPU, a memory and an output means (not shown), and is constituted by a computer for performing the above given processings based on the input through the input member 41 that is made up of a key board, a mouse, a GUI or the like. The controller 4 and the input member 41 may be realized by assigning a controller of any one of the sheet feeder 5 and the printing unit 6 as the controller 4 and the input member 41, of this sheet aligning device, or by assigning a control device for control of the entire operation of the printing press, which includes the aligning device, the sheet feeder 5 and the printing unit 6, as the controller 4 and the input member 41, of this aligning device, or by separately providing the controller 4 and the input member 41 exclusively used for this aligning device.

Now, the description will be made for the operation of the thus arranged aligning device.

The operator first inputs the size or the like of the sheets 2 to be printed through the input member 41. A memory device of the controller 4 stores information as to which one of the aligning plates 3 is to be used according to the size of the sheet 2 stored therein, and stores preset positions (moving control positions) for the aligning plates 3, to which they are moved upon selection. Specifically, in this embodiment, the controller 4 performs the control of the operations so that it reads out the moving amount of each of the aligning plates 3 (the first and second aligning plates 3U, 3N) stored in the memory in association with the size or especially the width of the sheets 2 inputted through the input member 41, then moves each of the aligning plates 3 (the first and second aligning plates 3U, 3N) before the printing operation, and then starts the printing operation. Which aligning plate is to be used may be determined based on automatic selection according to the size or the like, of the sheet 2 by the controller 4, or based on manual input by the operator.

The control by the controller 4 for the aligning plate out of use (the second aligning plate 3N) is made as follows: It is to be noted that when the first aligning plate 3U is designated as an aligning plate out of use for alignment, the following description will be applied to the first aligning plate 3U and the second lateral side 21' should be read as the "first lateral side 21".

When the sheets 2 to be conveyed have a width equal to or larger than the given width $X_1$, the second aligning plate 3N is preset at a position allowing the second lateral side 21' of each sheet 2 to pass through the sheet-lateral-side passing zone P1 on the second aligning plate 3N that is defined between the sheet abutting surface A and a lateral side C (a lateral side close to the sheet abutting surface A) of the receiving roller 33 of the sheet pulling device 31 on the second aligning plate 3N and that has a flat surface throughout the sheet conveying direction T; when the sheets 2 to be conveyed have a width w smaller than the given width $X_1$ but equal to or larger than $X_2$, the second aligning plate 3N is preset at a position allowing the second lateral side 21' of each sheet 2 to pass through the sheet-lateral-side passing zone P2 that is defined between a laterally inward side D (a lateral side close to the axis or centerline of the sheet) of the receiving roller 33 of the sheet pulling device 31 on the aligning plate 3N and the laterally inward side B (the lateral side close to the axis or centerline of the sheet 2, or an outer end portion of the bellows-mechanism mounting portion 37) of the second aligning plate 3N and that has a flat surface throughout the sheet conveying direction T therebetween (that is, the sheet-lateral-side passing zone P2 defined between the laterally inward side D and the laterally inward side E); and when the sheets 2 to be conveyed have a width w smaller than the given width $X_2$, the aligning plate 3N is preset at a position allowing the second lateral side 21' of each sheet 2 to pass through a portion (a sheet-passing zone P3) located sufficiently away from the laterally inward side B (the lateral side close to the axis or centerline of the sheet) of the second aligning plate 3N.

Figure 3:
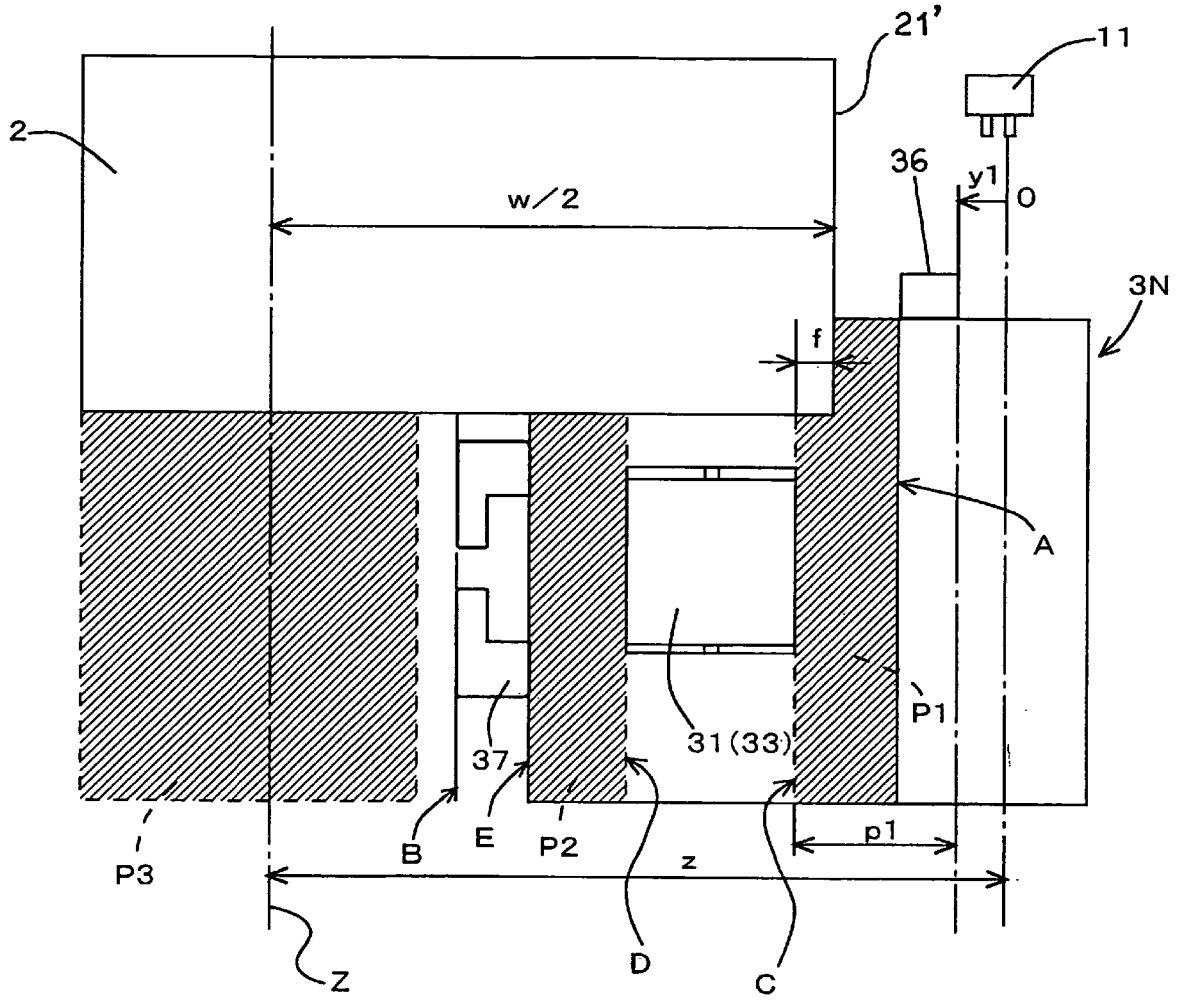
FIG. 3 is a view illustrating one relationship between an aligning plate, which is out of use for alignment, and a sheet passing therealong, in the sheet aligning device of FIG. 1.
Figure 4:
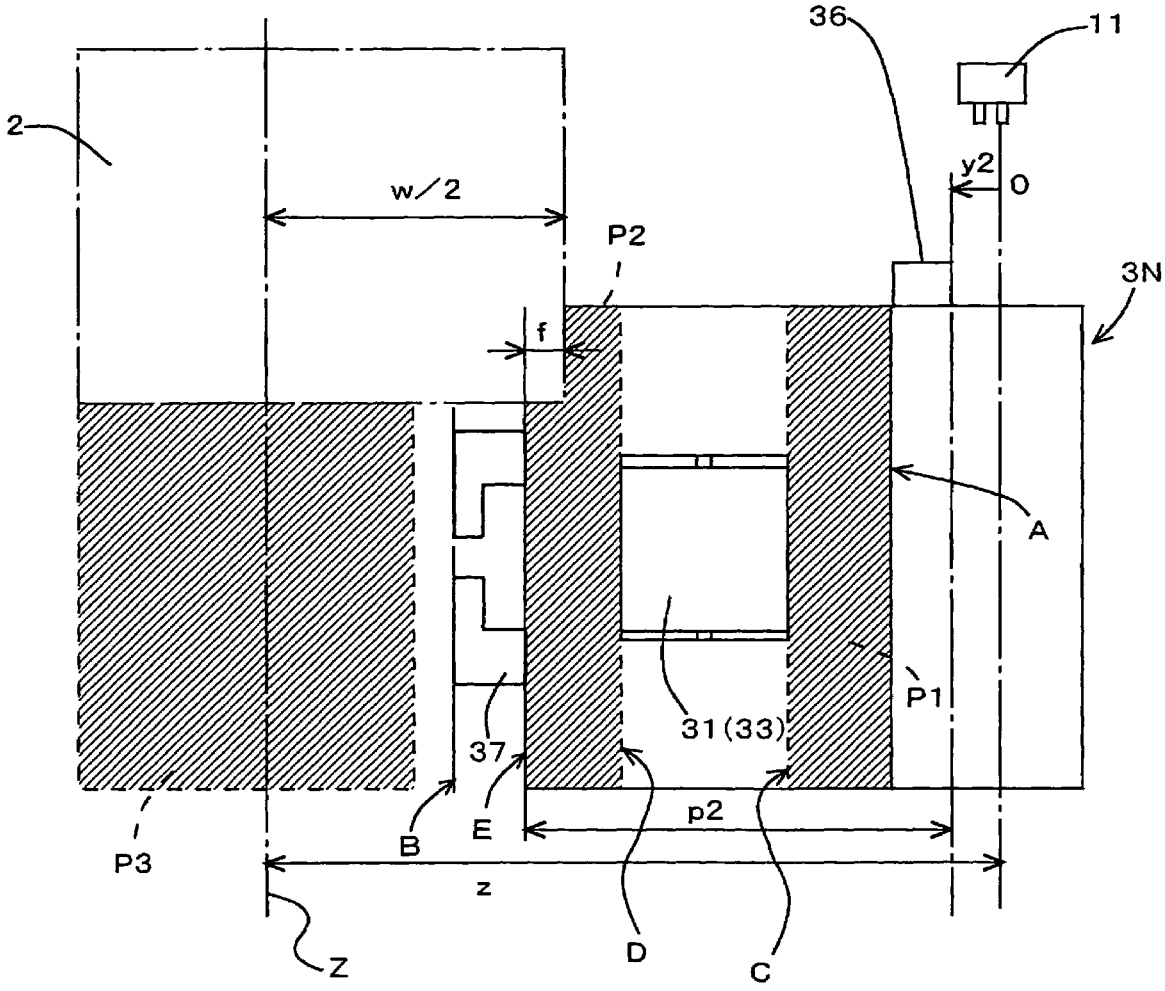
FIG. 4 is a view illustrating another relationship between an aligning plate, which is out of use for alignment, and a sheet passing therealong, in the sheet aligning device of FIG. 1.
Figure 5:
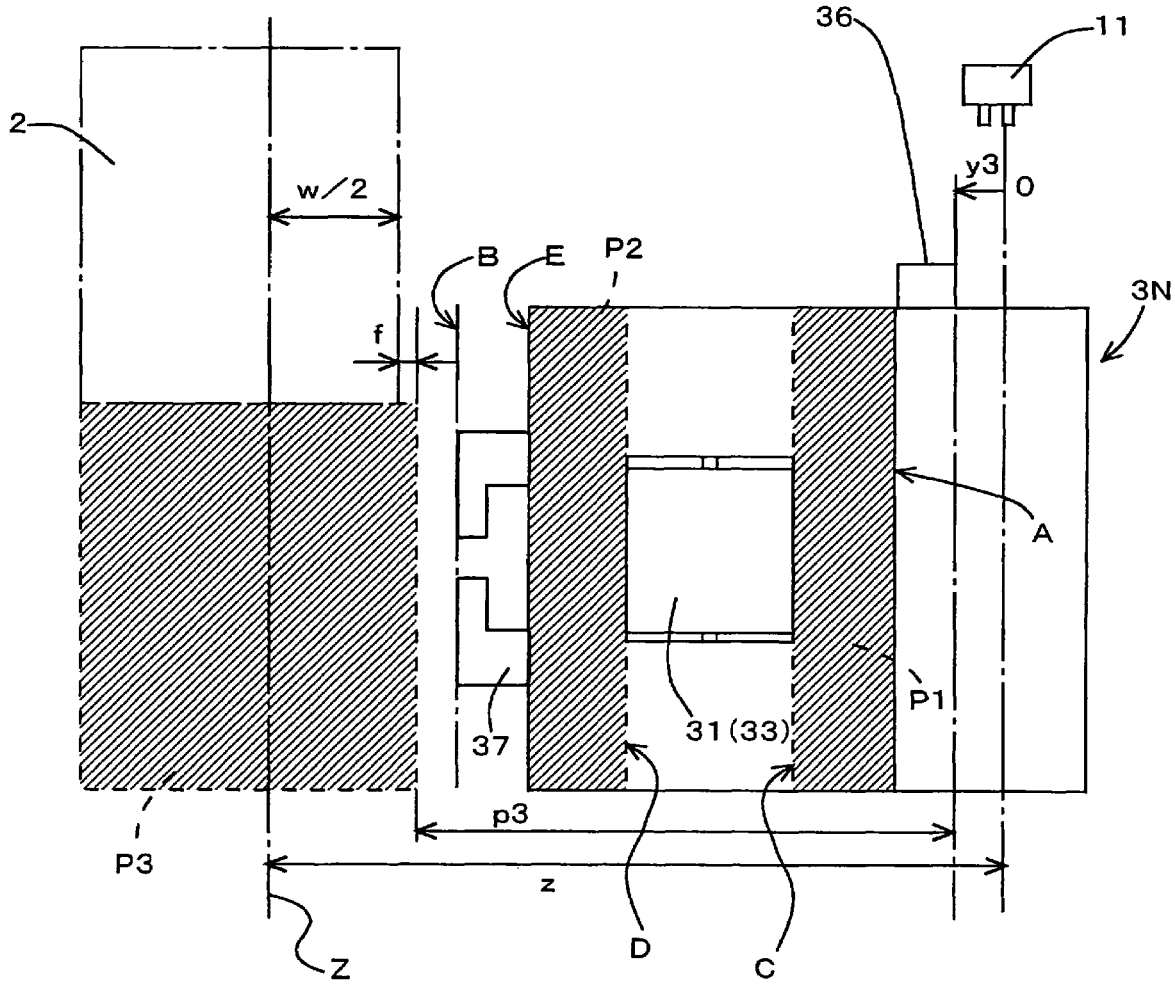
FIG. 5 is a view illustrating still another relationship between an aligning plate, which is out of use for alignment, and a sheet passing therealong, in the sheet aligning device of FIG. 1.

FIGS. 3 to 5 each are a view illustrating a relationship between an aligning plate out of use for alignment, and a sheet passing therealong, in the sheet aligning device of FIG. 1. Each Figure illustrates a cross sectional view taken along a line S-S in FIG. 2B.

In this embodiment, the moving amount of each of the aligning plates 3 is preset according to the size of the sheets 2, based on the assumption that the axis or centerline of each sheet 2 to be fed from the sheet feeder 5 and conveyed on the feeder board 1 passes through a given reference line Z or its proximity. After the alignment of the sheet 2 is made by the sheet pulling device 31 of the first aligning plate 3U (the plate designated for alignment in this embodiment), it is not anticipated that the second lateral side 21' of each sheet is caught or hooked against the portions as mentioned above on the side of the second aligning plate 3N (the aligning plate out of use). Therefore, the moving amount preset in the manner mentioned above is determined based on the relationship between the initial lateral (or widthwise) position of the sheets 2 and the aligning plates 3 at the time when they are conveyed on the feeder board 1. Accordingly, in a case where a sheet has its second lateral side 21' passing through the sheet-lateral-side passing zone P before the sheet 2 is laterally aligned by the sheet pulling device 31, such a sheet is not required to have its second lateral side again passing through the sheet-lateral-side passing zone P after the lateral alignment by the sheet pulling device 31 is made.

For example, in FIG. 3, the sheet width w, the distance z from the original position (the position of the original position sensor 11) to the reference line Z, the distance p1 from the reference position (the position of the reference member 36) of the second aligning plate 3N to the far side (a lateral side close to the axis or centerline of the sheet) of the sheet-passing zone P1, and a pulling margin f (i.e., a sufficient width allowing the second lateral side 21' of each sheet 2 to enter inside of the sheet-lateral-side passing zone P1 through the lateral side C of the receiving roller 33; this lateral side being a far side of the sheet-lateral-side passing zone P1), are used to calculate the moving amount of the second aligning plate 3N (a relative distance of the reference member 36 to the original position sensor 11) y1 by the following equation:

$$y1=z-p1+f-w/2$$

In FIG. 4, the distance p2 from the reference position of the second aligning plate 3N to the far side of the sheet-lateral-side passing zone P2 is used in place of the distance p1 to calculate the moving distance y2 of the second aligning plate 3N in the same manner as in FIG. 3 by the following equation:

$$y2=z-p2+f-w/2$$

Herein, the moving amount y2 is controlled so as to be applied to the sheet 2 having a width w of $w/2<z-p2+f$. That is, as a reference value $X_1$ for switching, $X_1/2=z-p2+f$ is employed. In this respect, it is possible to set a value, which is equal to or more than the value of z−p2+f, as a given reference value $X_1/2$.

In FIG. 5, when, in place of the distance p2, the relationship between the distance p3 from the reference position of the second aligning plate 3N to a portion away from the bellows-mechanism mounting portion 37 (or the laterally inward side B of the second aligning plate 3N close to the axis or centerline of the sheet) and the width w of the sheet 2 can be represented by $w/2<z-p3-f$, the sheet 2 to be conveyed is recognizable as having a width small enough to allow the second aligning plate 3N to be retracted, and therefore the moving distance y3 is set to allow the second aligning plate 3N to move a maximum distance towards a corresponding lateral side of the feeder board 1 (y3=0 or a small value around 0).

The moving distance may be made by the operator at his or her discretion according to the size or specification of the sheet 2, as well as being made by the presetting mentioned above.

After the moving distance of the second aligning plate 3N, which is not used for aligning the sheets 2, has been preset in the manner as mentioned above, the first aligning plate 3U for use in aligning the sheets 2 and the second aligning plate 3N not for use in aligning the sheets 2 are respectively moved by the driving member 35. Herein, for moving the first and second aligning plates 3U, 3N, they are first moved towards respective lateral sides of the feeder board 1, and once stopped respectively at positions at which the corresponding original position sensors 11 detect the corresponding reference members 36, so that the moving distances each are reset to 0. Then, the first and second aligning plates 3U, 3N each are moved by a distance thus preset towards the axis or centerline of the feeder board 1. These aligning plates 3U, 3N may be simultaneously or successively moved. After they have been moved by the present distances, the sheet feeder 5 is actuated to convey the sheets 2 through the feeder board 1. The sheets 2 are then successively aligned on the feeder board 1 and the printing operation is started at the printing unit 6.

Thus, the width w of the sheets 2 to be conveyed is smaller than the given value $X_2$, the second aligning plate 3N, which is not used for the alignment of the sheets 2, is retracted to a position sufficiently away from the sheet 2 on the feeder board 1. Whilst, only for the sheets 2 having a width w equal to or larger than the given value $X_1$ or $X_2$, which necessarily have the second lateral sides passing on the second aligning plate 3N even if the second aligning plate 3N is retracted as far as possible away from these sheets 2, the second aligning plate 3N is positively controlled so that the second lateral side 21' of each sheet 2 passes through an area (the sheet-lateral-side passing zone P1 or P2) on the second aligning plate 3N, thereby allowing the sheets to be smoothly conveyed without block or interruption.

According to the above arrangement, the second aligning plate 3N is controlled to be positively moved to a position allowing the second lateral side 21' of each sheet 2 to pass through an area (the sheet-lateral-side passing zone P1 or P2), through which each sheet 2 is hardly caught or hooked, and hence there is caused no block or interruption. This therefore prevents the second lateral side 21' of each sheet 2 from being caught or hooked during the alignment operation, and thus prevents errors in registration for printing. Another advantage is that when this control is made only for sheets having a width equal to or larger than a given value X, a printing operation is more rapidly started. Still another advantage is that the arrangement with the sheet-lateral-side passing zones disposed on the opposite lateral sides of the sheet pulling device 31 enables the second aligning plate 3N to be controlled so as to be moved only by a shortest distance, and therefore the printing operation is more rapidly started.

In this embodiment, any one of the sheet-lateral-side passing zones P1 and P2 are selectively used as the sheet-lateral-side passing zone P on the aligning plate 3N, according to the size of the sheets 2. Alternatively, only one of them may be used.

Figure 6:
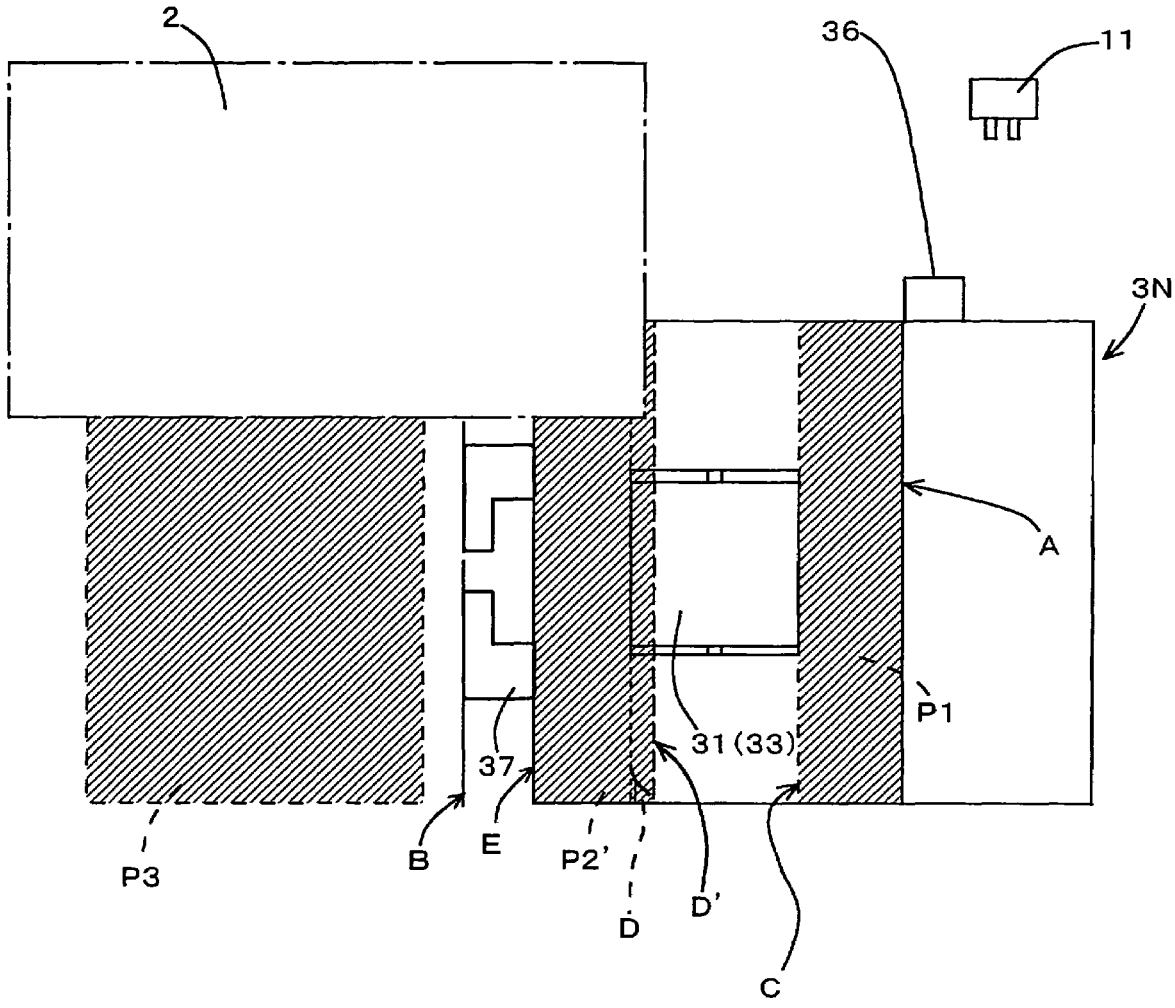
FIG. 6 is a view illustrating a relationship between an aligning plate, which is out of use for alignment, and a sheet passing therealong, in another embodiment of the sheet aligning device of FIG. 1.

In this embodiment, the sheet-lateral-side passing zones P1, P2 are set based on the assumption that the entire region of the opening (or a recess), in which the receiving roller 33 of the sheet pulling device 31 is fitted, is easy to catch or hook the lateral sheet end 21 of the sheet 2, or is easy to cause errors in registration for printing. However, an area located laterally inwardly with a distance (e.g., about 5 mm) away from either lateral side of the recess, which lateral side corresponding to the aforesaid side D or C), may be set as the sheet-lateral-side passing zone P, as well. FIG. 6 is a view illustrating a relationship between an aligning plate out of use for alignment and a sheet passing therealong, in the sheet aligning device of FIG. 1 in another embodiment. In FIG. 6, the sheet-lateral-side passing zone P2' is made up of an area between the laterally inward side D and a lateral side D' positioned at a given distance laterally away from the laterally inward side D, and the sheet-lateral-side passing zone P2 that is defined between the laterally inward side D (the lateral side close to the axis or centerline of the sheet) of the receiving roller 33 of the sheet pulling device 31 and the laterally inward side B of the second aligning plate 3N (the outer end of the bellows-mechanism mounting portion 37) (or defined between the laterally inward side D and the laterally inward side E) and that has a flat surface throughout the sheet conveying direction T therebetween. The other sheet-lateral-side passing zones P1, P3 are allocated in the same manner as mentioned in the above embodiments, while an area extending a given distance laterally inwardly from the lateral side C may be allocated as an additional part of the sheet-lateral-side passing zone P1.

As mentioned above, in the arrangement in which the receiving roller 33 is mounted as the sheet pulling device 31 on each aligning plate 3, when the receiving roller 33 of the second aligning plate 3N (the aligning plate out of use for alignment) is kept rotated, it is easy to cause misalignment of the sheet 2 since the receiving roller 33 pulls the sheet 2 at a portion around the center (with respect to the lateral direction of the sheet) of the recess where the distance (difference in height) between the plate surface and the receiving roller 33 is short. On the other hand, it is not easy to cause misalignment of the sheet at a portion around a lateral side (with respect to the lateral direction of the sheet) of the recess where the distance between the plate surface and the receiving roller 33 is longer than the distance around the center area of the recess, even for the sheet 2 having a curled or bent portion, since such a portion slips into a relatively large gap defined between the plate surface and the receiving roller 33.

Meanwhile, where the second lateral side 21' of each sheet 2 is to pass through the sheet-lateral-side passing zone P1 (i.e., in a case illustrated in FIG. 3), the sheet 2 necessarily passes near the sheet abutting surface A of the second aligning plate 3N (the aligning plate out of use for alignment), and therefore where the sheet 2 conveyed on the feeder board 1 is greatly displaced from the right position, the second lateral side 21' of the sheet 2 on the side of the second aligning plate 3N may hit or come into engagement with the sheet abutting surface A of the second aligning plate 3N. Therefore, there is a case where the second aligning plate 3N is better to be located so that the second lateral side 21' of the sheet 2 passes through an area located as far as possible from the sheet-end abutting surface A (a sheet-lateral-side passing zone close to the axis or centerline of the sheet on the second aligning plate 3N).

In the above operation, the area on the recess around its lateral side (with respect to the lateral direction of the sheet) is allocated as an additional part of the sheet-lateral-side passing zone P2', so that the control is made so as to allow the lateral side (the second lateral side 21' in this embodiment) of the sheet 2 to pass through an area of the sheet-lateral-side passing zone P located as far as possible from the sheet abutting surface A. More preferably, the control is made so that all the sheets 2 have their lateral sides (the second lateral sides 21' in this embodiment) pass through the sheet-lateral-side passing zone P2' or P3.

Whereby, it is possible to prevent the lateral side (the second lateral side 21' in this embodiment) of each sheet 2 from hitting or coming into engagement with the sheet-abutting surface A of the second aligning plate 3N (the aligning plate out of use for alignment), causing no block or interruption and thus preventing errors in registration for printing.

This embodiment was made by taking for example the arrangement where the pressing roller 32 and the receiving roller 33 are used as the sheet pulling device 31. The present invention is not necessarily limited to this arrangement and it is possible to employ a variety of arrangements for the sheet pulling device 31 such as an arrangement where suction holes are formed in a give surface area of each aligning plate, which area is flush with the feeder board 1, and air is sucked therethrough so that the first lateral side 21 of each sheet 2 is brought into abutment with the sheet abutting surface A of the first aligning plate 3U.

Furthermore, in this embodiment, the control is made so that the aligning plates 3 are previously moved to the respective positions and then the printing operation is started. Alternatively to this, it is possible to control the aligning plates 3 to be moved to the respective positions every time each sheet 2 is conveyed, while the printing operation is being carried out.

This specification is by no means intended to restrict the present invention to the preferred embodiments set forth therein. Various modifications to the sheet aligning device and the method of controlling the same, as described herein, may be made by those skilled in the art without departing from the spirit and scope of the present invention as defined in the appended claims.

What is claimed is:

1. A sheet aligning device of a printing press disposed downstream of a feeder board for laterally aligning each of sheets of paper during conveying of said sheets by the feeder board from a sheet feeder to a printing unit in a sheet conveying direction comprising:

first and second aligning plates disposed on opposite lateral sides of the feeder board, said first and second aligning plates respectively having driving members that reciprocate independently of each other in a direction orthogonal to the sheet conveying direction and each having a sheet abutting surface parallel to the sheet conveying direction;

an input member for inputting a sheet width; and a controller for controlling the first and second aligning plates so that:

the first aligning plate is moved to allow the sheet abutting surface thereof to be brought into abutment with a first lateral side of each sheet, thereby allowing the distance between the sheet abutting surface of the first aligning plate and a reference line set along the sheet conveying direction to be half of the width of the sheet inputted by the input member, and thus laterally aligning the sheet;

wherein in a case where the input sheet width is equal to or larger than a given sheet width, the second aligning plate is moved to allow the distance between the sheet abutting surface of the second aligning plate and the reference line set along the sheet conveying direction to be more than half of the width of the sheet inputted by the input member thereby allowing a second lateral side of each sheet to pass through a sheet-lateral-side passing zone on the second aligning plate, said sheet-lateral-side passing zone being located closer to a centerline of the sheet than the sheet abutting surface of the second aligning plate is and having a flat surface throughout the sheet conveying direction; and wherein in a case where the input sheet width is smaller than the given sheet width, allowing the second lateral side of each sheet to pass through a given area, said given area being located away from a laterally inward side of the second aligning plate, said laterally inward side being close to the centerline of the sheet.

2. The sheet aligning device according to claim 1, wherein the first and second aligning plates each have a sheet pulling device between the sheet abutting surface and the laterally inward side thereof, wherein said laterally inward side is close to the axis or centerline of the sheet, and any one of a first area and a second area is allocated as the sheet-end passing zone of each of the first and second aligning plates, wherein said first area is defined between the corresponding sheet abutting surface and the corresponding sheet pulling device and has a flat surface throughout the sheet conveying direction, and said second area is defined between the corresponding laterally inward side and corresponding sheet pulling device and has a flat surface throughout the sheet conveying direction.

3. The sheet aligning device according to claim 2, wherein the sheet pulling devices each include a pressing roller for pulling the sheet towards the corresponding sheet abutting surface while applying a pressure thereon and a receiving roller disposed opposite the pressing roller.

4. A method of controlling a sheet aligning device of a printing press disposed downstream of a feeder board for laterally aligning each of sheets of paper during conveying of said sheets by the feeder board from a sheet feeder to a printing unit in a sheet conveying direction, by using first and second aligning plates that are disposed opposite lateral sides of the feeder board, said first and second aligning plates respectively having driving members that reciprocate independently of each other in a direction orthogonal to the sheet conveying direction and each having a sheet abutting surface parallel to the sheet conveying direction, said method comprising:

controlling the first aligning plate to move said first aligning plate to allow the sheet abutting surface thereof to be brought into abutment with a first lateral side of each sheet, thereby allowing the distance between the sheet abutting surface of the first aligning plate and a reference line set along the sheet conveying direction to be half of the width of the sheet inputted by an input member, and thus laterally aligning the sheet; and wherein in a case where the width of the sheet is equal to or larger than a given sheet width, controlling the second aligning plate to move said second aligning plate to allow the distance between the sheet abutting surface of the second aligning plate and the reference line set along the sheet conveying direction to be more than half of the width of the sheet inputted by the input member thereby allowing a second lateral side of each sheet to pass through a sheet-lateral-side passing zone on the second aligning plate, said sheet-lateral-side passing zone being located closer to a centerline of the sheet than the sheet abutting surface of the second aligning plate is and having a flat surface throughout the sheet conveying direction, and wherein in a case where the width of the sheet is smaller than the given sheet width, allowing the second lateral side of each sheet to pass through a given area, said given area being located away from a laterally inward side of the second aligning plate, said laterally inward side being located close to the centerline of the sheet.

* * * * *